US008137069B2

(12) United States Patent
Khanin et al.

(10) Patent No.: US 8,137,069 B2
(45) Date of Patent: Mar. 20, 2012

(54) TURBINE BLADES

(75) Inventors: Alexander Khanin, Moscow (RU); Edouard Sloutski, Moscow (RU); Andrey Morozov, Khimki (RU)

(73) Assignee: Alstom Technology Ltd, Baden (CH)

( * ) Notice: Subject to any disclaimer, the term of this patent is extended or adjusted under 35 U.S.C. 154(b) by 119 days.

(21) Appl. No.: 12/638,580

(22) Filed: Dec. 15, 2009

(65) Prior Publication Data

US 2010/0158701 A1 Jun. 24, 2010

Related U.S. Application Data

(63) Continuation of application No. PCT/EP2008/056051, filed on May 16, 2008.

(30) Foreign Application Priority Data

Jun. 15, 2007 (EP) ..... 07110385

(51) Int. Cl.
*F01D 5/18* (2006.01)

(52) U.S. Cl. ..... 416/97 R; 164/132; 164/516; 29/889.7; 29/527.5; 416/224; 415/115

(58) Field of Classification Search ..... 415/115; 416/96 R, 97 R, 96 A, 224
See application file for complete search history.

(56) References Cited

U.S. PATENT DOCUMENTS 4,162,173 A * 7/1979 Arendt et al. ..... 134/2
4,177,010 A 12/1979 Greaves et al.
6,454,156 B1 * 9/2002 Taras et al. ..... 228/165
6,485,255 B1 11/2002 Care et al.
6,631,561 B1 * 10/2003 Anding et al. ..... 29/889.721
6,634,858 B2 * 10/2003 Roeloffs et al. ..... 416/97 R
(Continued)

FOREIGN PATENT DOCUMENTS

EP 1099825 A1 5/2001
(Continued)

OTHER PUBLICATIONS

International Search Report (PCT/ISA/210) for PCT/EP2008/056051 mailed Nov. 25, 2008.

(Continued)

*Primary Examiner* — Edward Look
*Assistant Examiner* — Ryan Ellis
(74) *Attorney, Agent, or Firm* — Buchanan Ingersoll & Rooney PC

(57) ABSTRACT

A cast turbine blade is disclosed and includes an internal cooling passage that passes (e.g., zig-zags or meanders) through the blade from an inlet in the blade root to an outlet in the blade tip. The cooling passage can have a zone at a bend that is at a distance which is remote from the inlet of the cooling passage when the distance from the inlet is measured around the passage, but that is closer to the inlet when the distance from the inlet is measured in a straight line. During casting of the blade, the cooling passage can be defined by a core or cores having a leachable material, the cores being removed after casting by a chemical leaching process. A supplementary passage is also provided for connecting the remote zone to the inlet during the leaching process. The supplementary passage can likewise be defined by a leachable core, or it may be machined into the blade after casting. During the service life of the blade, a plug can be used to obturate the supplementary passage to prevent leakage of cooling air from the cooling passage through the supplementary passage.

13 Claims, 3 Drawing Sheets

U.S. PATENT DOCUMENTS

| | | | | |
|---|---|---|---|---|
| 6,966,756 | B2 * | 11/2005 | McGrath et al. | 416/97 R |
| 2002/0197161 | A1 | 12/2002 | Roeloffs et al. | |
| 2005/0152785 | A1 | 7/2005 | McGrath et al. | |
| 2007/0041836 | A1 | 2/2007 | Tschuor et al. | |
| 2007/0071593 | A1 | 3/2007 | Rathmann | |
| 2007/0154312 | A1 | 7/2007 | Neuhoff et al. | |

FOREIGN PATENT DOCUMENTS

| | | | |
|---|---|---|---|
| EP | 1267040 | A2 | 12/2002 |
| EP | 1591626 | A1 | 11/2005 |
| GB | 1551678 | | 8/1979 |
| WO | WO 2005/095761 | A1 | 10/2005 |
| WO | WO 2006/029983 | A1 | 3/2006 |

OTHER PUBLICATIONS

Written Opinion (PCT/ISA/237) for PCT/EP2008/056051 mailed Nov. 25, 2008.

European Search Report for EP 07110385.7 dated Jan. 16, 2008.

* cited by examiner

TURBINE BLADES

RELATED APPLICATIONS

This application claims priority as a continuation application under 35 U.S.C. §120 to PCT/EP2008/056051, which was filed as an International Application on May 16, 2008 designating the U.S., and which claims priority to European Application 07110385.7 filed in Europe on Jun. 15, 2007. The entire contents of these applications are hereby incorporated by reference in their entireties.

FIELD

The present disclosure relates to internally cooled turbine blades in gas turbines, such as cast blades that can facilitate removal of cores from cooling passages during manufacture.

BACKGROUND INFORMATION

Turbine blades in modern gas turbine engines can be exposed to high operational temperatures, such as temperatures in the high-pressure part of the turbine. For this reason, such turbine blades can be provided with internal passages through which cooling air is circulated. Cooling air which is bled from one or more compressor stages in the gas turbine engine, can impose a performance penalty on the engine. In such a case, the blade designer can seek to minimise cooling air consumption by designing the blades with complicated internal cooling passages. Modern high pressure turbine blades can be manufactured using the "lost wax" shell moulding process, in which the internal cooling passages are defined within the wax blade shape by cores made of a ceramic or other leachable material. When the wax is melted out of the shell mould and replaced by molten metal alloy, the ceramic cores remain in the solidified cast blade to define the internal cooling passages. The ceramic cores are removed during the last stages of the manufacturing process by, for example, a leaching process that dissolves the ceramic cores out of the blade internals using a caustic chemical composition.

FIG. 1A shows a longitudinal (root to tip) section through a known high pressure turbine blade 10, in which the arrows show the directions of the air cooling flows. An internal cooling passage 12 follows an "up-and-down" route through the blade, in which a first leg 12*a* of the passage extends from an inlet 14 at the root of the blade up to the blade tip, a second leg 12*b* doubles back on the first leg 12*a*, and a third leg 12*c* doubles back on the second leg 12*b*, before the passage terminates at a dust hole 16 in the blade tip. In this way, an increase in cooling duty can be obtained from the cooling air. Because passage 12 was defined in the casting by a ceramic core or the like, dissolving the core from the parts of passage 12 that are remote from the inlet 14, such as from the bend zone 18 between legs 12*b* and 12*c*, can be particularly difficult. Leaching out the ceramic core in this zone can take a long time, thereby adding expense to the manufacturing process, and unless particular care is taken, there is a possibility that remnants of the core will remain inside the cooling passage.

It is known from EP-A-1 267 040 and other documents to define small openings in internal cooling passage walls of the casting by thin ancillary core portions that join one part of the ceramic core to another part. This can be done to provide support to cores during the casting process. After the part is cast and the core has been leached out, the opening can be closed off with a plug that is securely fixed into place.

SUMMARY

A cast turbine blade is disclosed comprising: a blade root and a blade tip; at least one internal cooling passage that passes from an inlet in the blade root to an outlet in the blade tip, the cooling passage having a zone that is at a distance which is remote from the inlet of the cooling passage when the distance from the inlet is measured along the cooling passage, but that is closer to the inlet when the distance from the inlet is measured in a straight line; a supplementary passage that extends between the zone and the inlet through an internal wall of the cooling passage, wherein the supplementary passage is elongate and passes in a straight line from an aperture in an external surface of a base of the blade root, through the blade root, the inlet and the internal wall, to the zone; and a plug which obturates the supplementary passage wherein the plug is elongate and substantially co-extensive with the supplementary passage.

A method of manufacturing a turbine blade is disclosed using the lost wax casting process, the method comprising: casting a cooling passage that extends from an inlet in a root portion of the blade to an outlet in a tip portion of the blade, the cooling passage having a zone that is at a distance which is remote from the inlet of the cooling passage when the distance from the inlet is measured along the passage, but that is closer to the inlet when the distance from the inlet is measured in a straight line; and casting a supplementary passage for connecting the zone to the inlet during the manufacture of the blade, wherein the cooling passage and the supplementary passage are defined by at least one core comprising a leachable material.

BRIEF DESCRIPTION OF THE DRAWINGS

Exemplary embodiments of the disclosure will be described herein, with reference to the accompanying drawings, in which.

DETAILED DESCRIPTION

Figure 1A:
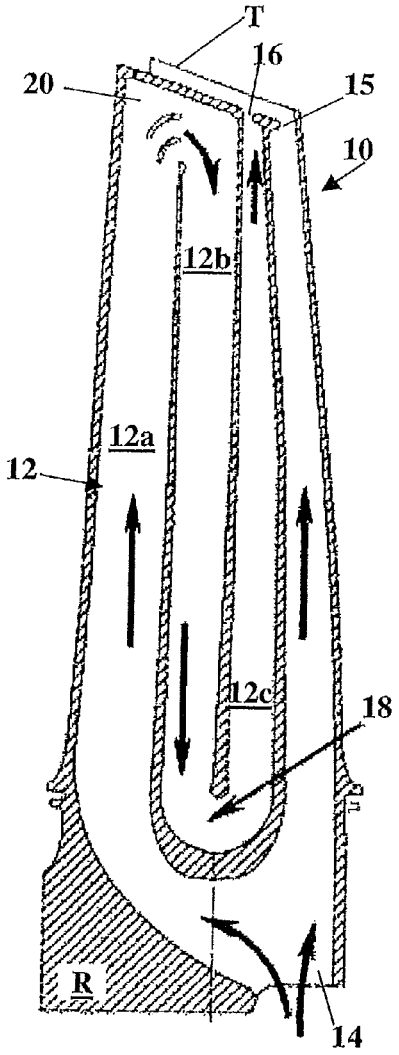
FIG. 1A is a sectional side elevation showing a longitudinal (root to tip) section through a known high pressure turbine blade.

According to the present disclosure, a cast turbine blade having a blade root and a blade tip is disclosed. According to an exemplary embodiment, at least one internal cooling passage passes (e.g., zig-zags, or meanders) through the blade from an inlet in the blade root to an outlet in the blade tip, the cooling passage having a zone that is remote from the inlet of the cooling passage when the distance from the inlet is measured around the passage, but that is closer to the inlet when the distance from the inlet is measured in a straight line. A supplementary passage extends between the remote zone and the inlet through an internal wall of the cooling passage, the supplementary passage being obturated by a (e.g., metallic) plug. The supplementary passage can be elongate, and pass in a straight line from an aperture in an external surface of the base of the blade root, through the blade root, the inlet and the internal wall, to the remote zone. The plug can also be elongate and substantially co-extensive with the supplementary passage.

The supplementary passage can possess an un-obturated state during a manufacturing process of the blade, such as during leaching out of ceramic cores from the cast blade, to connect the remote zone to the inlet and thereby improve access of leaching fluid to the remote zone. The supplementary passage can be obturated during a service life of the blade to prevent leakage of cooling air through the supplementary passage.

The remote zone of the cooling passage can be at a bend in the cooling passage.

The plug can be retained in a correct position in the supplementary passage against forces tending to push it further into the blade by a shoulder on the plug that bears against a complementary feature in the passage.

The plug can be retained in position against forces tending to remove it from the blade by an interference fit between the plug and the supplementary passage. For example, the interference fit can be obtained by deforming a feature on the plug to make it project into a recess of the supplementary passage. The feature on the plug can be a collar and the recess can include a wider part of the supplementary passage or an undercut in a wall of the supplementary passage. The collar can be caulked, swaged, or upset into a final position so as to grip the plug tightly and protrude into the recess in the passage.

Alternatively, after assembly of the blade into a turbine rotor, the plug can be retained in position against forces tending to remove it from the blade by abutment of an external end of the plug with a surface of the rotor.

An exemplary method of manufacture can include, during casting of the blade, defining the cooling passage by a core or cores having a leachable material, the supplementary passage being likewise defined by a leachable core, or machined into the blade after casting. After casting of the blade, the core material can be removed from the blade by a leaching process, during which the supplementary passage can facilitate quicker and more thorough removal of core material from the remote zone of the cooling passage, the supplementary passage being obturated by insertion of the plug after conclusion of the leaching process.

Figure 1B:
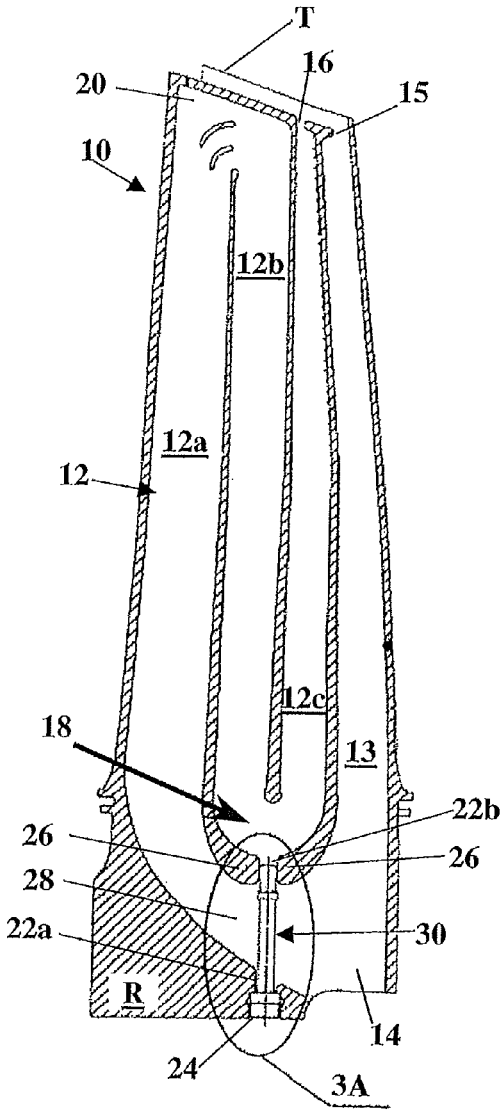
FIG. 1B is a view like FIG. 1A, showing a turbine blade that includes a first exemplary embodiment of the disclosure.

Referring to FIG. 1B, an exemplary cast turbine blade 10 includes an internal structure with two cooling passages 12 and 13. Cooling passage 13 extends longitudinally through the blade's leading edge region between an air inlet 14 in the blade's root region R and an air outlet 15 at its tip region T. However, cooling passage 12 passes (e.g., meanders or zigzags) through the blade's trailing edge and mid-chord regions from the air inlet 14 to an outlet having a relatively small hole (or "dust hole") that acts to throttle the flow of cooling air through the passage 12.

A first leg 12*a* of passage 12 extends longitudinally through the blade's trailing edge region between the air inlet 14 in the root R and a bend 20 at the tip T of the blade. At the tip, the passage 12 doubles back on itself to form its second leg 12*b*, which extends longitudinally through the mid-chord region of the blade from the blade tip T to a bend zone 18 near the root. Here, the passage doubles back on itself again to form its third leg 12*c*, which extends longitudinally through the mid-chord region of the blade from the zone 18 to the outlet 16 in the blade tip.

After casting of the blade, the ceramic cores or the like that define the cooling passages 12 and 13 of the exemplary FIG. 1B embodiment can be removed from the blade by a leaching process, which initially can be assisted by a mechanical process to remove core material from the root region R of the blade in and near the inlet 14. The leaching fluid can, for example, be introduced through the inlet 14, but whereas removal of the core material from straight passage 13 can be accomplished relatively easily, removal of the core material from meandering passage 12 can be more difficult. This can be due not only to the length of the passage, but also to any sharp bends 20 and 18 between legs 12*a*/12*b* and 12*b*/12*c*. During the leaching process, an interface between the leaching fluid and the core material can effectively be a dead end, and removal of core material from bend zone 18 can be particularly slow, because it is so remote from the inlet 14. It can be difficult to circulate fresh leaching fluid from the inlet 14, through leg 12*a*, round the bend 20 and down leg 12*b*. Furthermore, unless great care is taken during the leaching process, un-dissolved remnants of the cores can remain in position on the walls of the passage 12, where fluid boundary layer effects can reduce the effectiveness of the leaching fluid. This issue can be more acute in remote bend zone 18, where fluid circulation velocities can be particularly low.

Figure 3A:
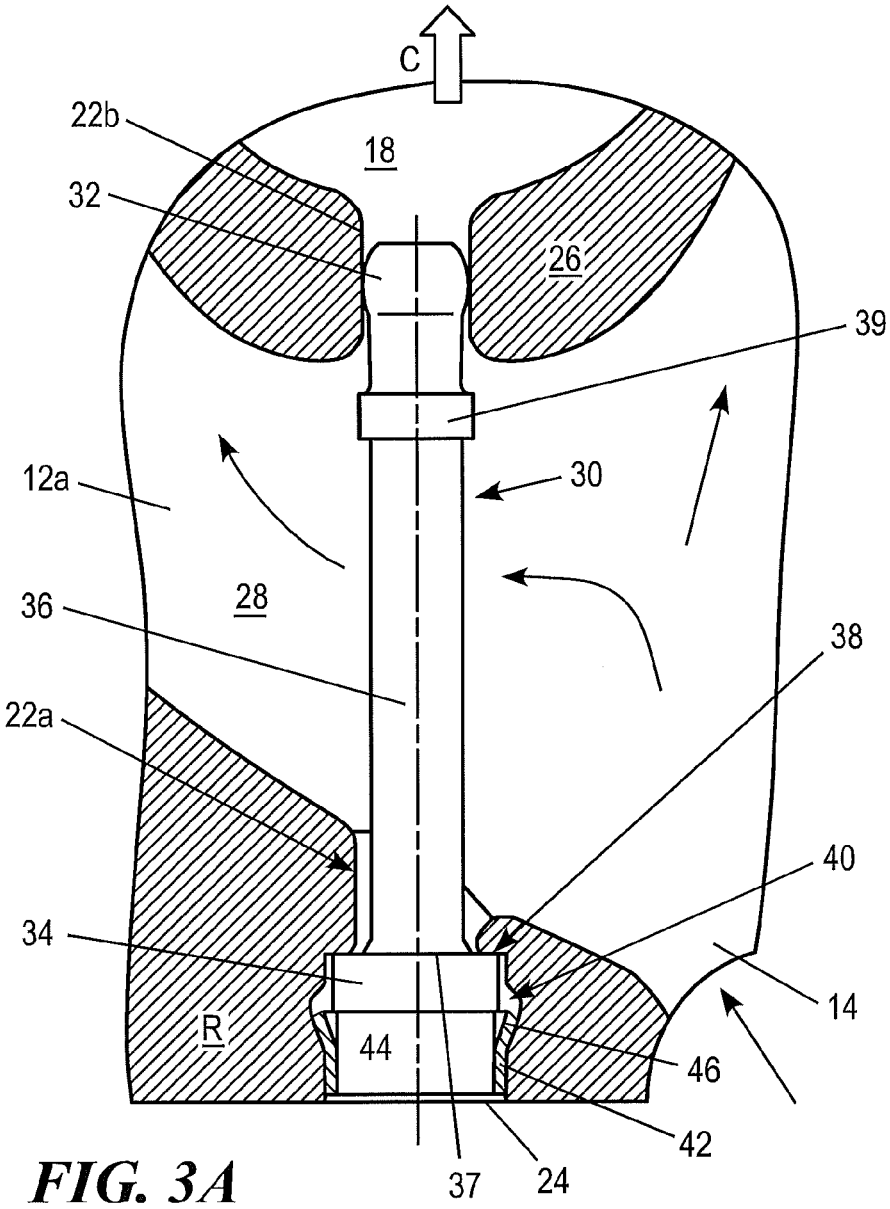
FIG. 3A is an enlarged view of the area 3A in the exemplary FIG. 1B embodiment.

Referring to FIGS. 1B and 3A, a supplementary or auxiliary passage 22 can connect the remote bend zone 18 in a straight line with an inlet region 28 of passage 12 and an aperture 24 in an external surface of the blade root R. The connection between the inlet region 28 and the aperture 24 can be made by a part 22*a* of the supplementary passage 22 that penetrates an external wall of the root R. The connection between the bend zone 18 and the inlet region 28 can be made by a part 22*b* of the supplementary passage 22 that penetrates an internal wall 26 defining the cooling passage 12 in the bend zone 18. After the core material has been removed from the root region of the blade, the supplementary passage can facilitate quicker removal of core material from the leg 12*b* of the passage 12 and the remote bend zone 18. This is because the core material in leg 12*b* and in part of bend zone 18 will be attacked by the leaching fluid from two directions at once, and because the direct connection of bend zone 18 with the inlet region 28 will allow the core material to be attacked by fresh leaching fluid that has not already done duty in removing core material from leg 12*b*.

During casting of the blade, the supplementary passage 22 can conveniently be defined by cores, which after casting can, for example, be easily removed mechanically, or leached out (e.g., during the initial stages of the leaching process). Alternatively, passage 22 can be readily machined into the blade after casting, but before the core removal process commences.

Figure 2:
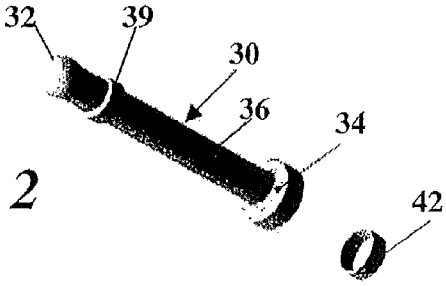
FIG. 2 is a pictorial perspective view of an exemplary plug used in the embodiment of FIG. 1B.

Referring to FIG. 2, after the core removal process is complete, a metallic plug 30 can be inserted into supplementary passage 22. This can prevent leakage of cooling air through passage portion 22*b*, from the bend zone 18 of passage 12 into its inlet region 28. It can also prevent leakage of cooling air through passage portion 22*a*, from inlet region 28 to the exterior. Plug 30 can, for example, be made from the same alloy as the turbine blade. To achieve obturation of the supplementary passage 22, plug 30 can have a bulbous end 32 for blocking the supplementary passage portion 22*b*, and an opposite cylindrical end 44 with a flange 34, which blocks the supplementary passage 22*a*. Advantageously, to ensure the fit of the plug 30 in passage portion 22*b* is airtight and to help secure the plug against vibration during operation of the gas turbine, the bulbous portion 32 can have a moderate interference fit in the passage portion 22*b*. Note that in the exemplary embodiment, the stem or shank 36 of the plug, which joins the plug's extremities, does not have a diameter large enough to interfere significantly with the flow of cooling air from inlet 14 into the first leg 12*a* of passage 12. However, if desired, it would be possible for stem 36 to have a larger diameter, calculated to throttle the cooling air flow into passage 12.

During operation of turbine blade 10 when installed on a gas turbine rotor, the blade can be retained to the rotor against powerful centrifugal forces by industry standard features provided on, or associated with, root R and the rotor. However, such centrifugal forces, acting in the direction shown by the arrow C (FIG. 3A), also act on the plug 30, tending to push it further into the blade. To retain the plug in the correct position against centrifugal forces, its flange 34 can provide a radially outwardly facing shoulder 37 that bears against a complementary shoulder feature 38 provided in the supplementary passage 22 where it passes through the root R.

An additional shoulder or flange 39 can be located as a fail-safe feature on the plug's stem 36, just under the bulbous portion 32. Flange 39 can have a greater diameter than the diameter of the supplementary passage 22 where it penetrates the cooling passage wall 26. Consequently, in the unlikely event that the stem 36 breaks during the service lifetime of the blade 10, flange 39 can prevent the bulbous portion 32 from being displaced into the bend zone 18 under the influence of centrifugal forces.

Figure 3B:
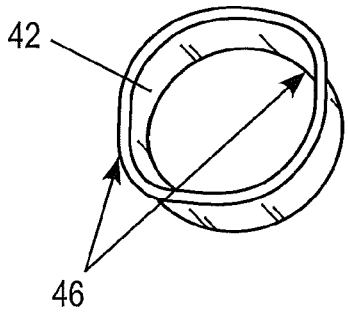
FIG. 3B is an enlarged view of an exemplary collar on the plug after deformation of the collar to secure the plug in the turbine blade.

Before, during and after installation of the turbine blade 10 on the gas turbine rotor, the plug 30 should be retained in position against forces tending to remove it from the blade. In an exemplary embodiment, such retention can be achieved by means of an interference fit between a feature on the cylindrical end portion 44 of plug 30 and an feature in the supplementary passage portion 22*a*. As shown, the feature in the supplementary passage can be a recess in the passage wall, having a shallow groove 40 that forms a wider part of the passage (an undercut portion of the passage wall would perform a similar function). The feature on the plug can be a cylindrical collar 42. After the plug 30 has been inserted into the supplementary passage 22, collar 42 can be slid over the cylindrical end portion 44 of the plug until it abuts the flange 34. The collar can be then deformed into position as shown, e.g., by a caulking, swaging, or upsetting operation, so that it tightly grips the cylindrical end portion 44 and portions of it (indicated by reference numerals 46 in FIGS. 3A and 3B) project into the groove 40.

Figure 4:
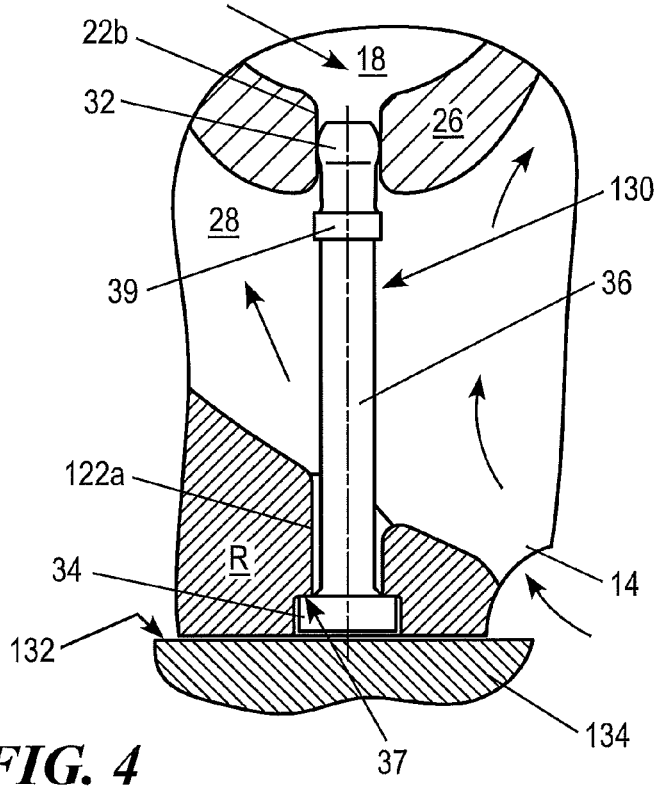
FIG. 4 is a view similar to FIG. 3A, but showing a second exemplary embodiment of the disclosure.

FIG. 4 illustrates an alternative exemplary way of retaining a plug 130 in the turbine blade 10 against forces tending to remove it from the blade. Features of the plug 130 that are identical with features on the plug 30 in FIGS. 1B and 3A have been given identical reference numerals and will not be described again. Plug 130 differs from plug 30 in that after assembly of the blade into a turbine rotor, the plug is retained in position against forces tending to remove it from the blade, by abutment of its flanged external end 34 with a surface 132 of the turbine rotor 134 adjacent the blade's root R. The features in FIGS. 1B and 3A that obtain an interference fit between the plug 30 and the supplementary passage portion 22*a* have been deleted from FIG. 4.

Figure 5:
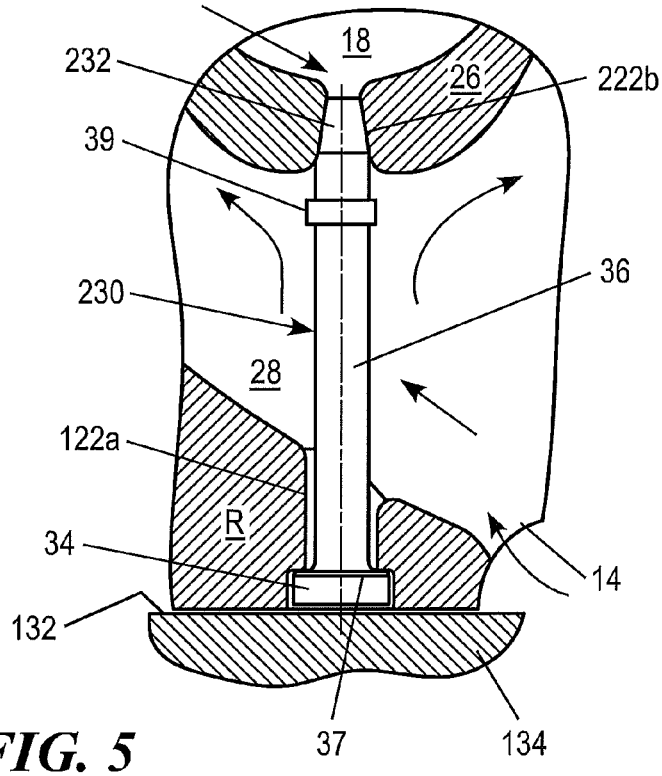
FIG. 5 is a modified version of the exemplary embodiment shown in FIG. 4.

FIG. 5 illustrates an exemplary plug 230 that is a modified version of the FIG. 4 embodiment. To further ensure no leakage of cooling air between bend region 18 and inlet region 28, the bulbous end portion 32 of the plug 130 in FIG. 4 has been replaced in FIG. 5 by a tapered end portion 232. The tapered end portion 232 mates with a similarly tapered portion 222*b* of the supplementary passage where it penetrates the inner wall 26. Of course, these features can also be substituted for the bulbous end portion 32 of plug 30 and the plain passage portion 22*b* in FIGS. 1B and 3A in any desired fashion.

The present disclosure has been described above purely by way of example, and modifications can be made within the scope of the disclosure as claimed. The disclosure also encompasses any individual features described or implicit herein or shown or implicit in the drawings or any combination of any such features or any generalisation of any such features or combination, which extends to equivalents thereof. Thus, the breadth and scope of the present disclosure should not be limited by any of the above-described exemplary embodiments. Each feature disclosed in the specification, including the claims and drawings, may be replaced by alternative features serving the same, equivalent or similar purposes, unless expressly stated otherwise.

Any discussion of the prior art throughout the specification is not an admission that such prior art is widely known or forms part of the common general knowledge in the field.

Unless the context clearly requires otherwise, throughout the description and the claims, the words "comprise", "comprising", and the like, are to be construed in an inclusive as opposed to an exclusive or exhaustive sense; that is to say, in the sense of "including, but not limited to".

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF DRAWING REFERENCES

R root region of turbine blade
T tip region of turbine blade
3A area of FIG. 3A
10 high pressure turbine blade
12 meandering cooling passage
12*a*-12*c* first, second and third legs of meandering cooling passage
13 longitudinally extending cooling passage
14 inlet of cooling passages
15 outlet of cooling passage 13
16 dust hole
18 remote bend zone of cooling passage 12
20 cooling passage bend in tip region T
22 supplementary passage
22*a*, 22*b* parts of supplementary passage
24 aperture
26 internal wall of cooling passage 12
28 inlet region of cooling passage 12
30 plug
32 bulbous end of plug 30
34 flanged end of plug 30
36 stem of plug 30
37 radially outward facing shoulder of plug
38 shoulder feature of supplementary passage 22
39 fail-safe flange
40 groove, recess
42 collar
44 cylindrical end of plug 30
46 deformed portions of collar 42
130 modified plug

132 surface of turbine rotor
134 turbine rotor
230 modified plug
232 tapered end of plug 230
222*b* tapered portion of supplementary passage

What is claimed is:

1. A cast turbine blade comprising:

a blade root and a blade tip;

at least one internal cooling passage that passes from an inlet in the blade root to an outlet in the blade tip, the cooling passage having a zone that is at a distance which is remote from the inlet of the cooling passage when the distance from the inlet is measured along the cooling passage, but that is closer to the inlet when the distance from the inlet is measured in a straight line;

a supplementary passage that extends between the zone and the inlet through an internal wall of the cooling passage, wherein the supplementary passage is elongate and passes in a straight line from an aperture in an external surface of a base of the blade root, through the blade root, the inlet and the internal wall, to the zone; and a plug which obturates the supplementary passage, wherein the plug is elongate and substantially co-extensive with the supplementary passage.

2. A cast turbine blade according to claim 1, wherein the zone of the cooling passage is at a bend in the cooling passage.

3. A cast turbine blade according to claim 1, wherein the plug is metallic, and comprises:

a shoulder for retaining the plug in a desired position in the supplementary passage to resist forces into the blade, the shoulder being configured to bear against a complementary feature in the supplementary passage.

4. A cast turbine blade according to claim 1, wherein the plug comprises:

an interference fit between the plug and the supplementary passage to retain the plug in position against forces tending to remove the plug from the blade.

5. A cast turbine blade according to claim 4, wherein the interference fit is configured as a deformation of a feature on the plug to make the plug project into a recess of the supplementary passage.

6. A cast turbine blade according to claim 5, wherein the feature on the plug is a collar and the recess comprises:

at least one of a wider part of the supplementary passage, and an undercut in a wall of the supplementary passage.

7. A cast turbine blade according to claim 1, comprising:

an abutment at an external end of the plug with a surface of the rotor to retain the plug in position against forces tending to remove it from the blade after assembly of the blade into a turbine rotor.

8. A method of manufacturing a turbine blade using the lost wax casting process, the method comprising:

casting a cooling passage that extends from an inlet in a root portion of the blade to an outlet in a tip portion of the blade, the cooling passage having a zone that is at a distance which is remote from the inlet of the cooling passage when the distance from the inlet is measured along the passage, but that is closer to the inlet when the distance from the inlet is measured in a straight line;

casting a supplementary passage for connecting the zone to the inlet during the manufacture of the blade, wherein the supplementary passage extends from an external surface of a base of the blade root, through the blade root, the inlet and an internal wall defining the cooling passage, to the zone, and wherein the cooling passage and the supplementary passage are defined by at least one core comprising a leachable material; and obturating the supplementary passage after removal of the core material by inserting a metallic plug into the supplementary passage to prevent leakage of cooling air through the supplemental passage, from the zone into the inlet, and leakage of cooling air through supplemental passage blade root portion from the inlet to an exterior.

9. The method of claim 8, comprising:

leaching the core material from the cooling passage, but removing the core material from the supplementary passage before the core material is leached from the remote zone.

10. The method of claim 9, wherein the removing of the core material from the supplementary passage is performed by a leaching process.

11. The method of claim 9, wherein the removing of the core material from the supplementary passage is performed by a mechanical process.

12. The method of claim 8, comprising:

configuring the supplementary passage to facilitate efficient leaching of core material from the zone of the cooling passage.

13. A method of manufacturing a turbine blade using the lost wax casting process, the method comprising:

casting a cooling passage that extends from an inlet in a root portion of the blade to an outlet in a tip portion of the blade, the cooling passage having a zone that is at a distance which is remote from the inlet of the cooling passage when the distance from the inlet is measured along the passage, but that is closer to the inlet when the distance from the inlet is measured in a straight line;

machining a supplementary passage for connecting the zone to the inlet during the manufacture of the blade, wherein the supplementary passage extends from an external surface of a base of the blade root, through the blade root, the inlet and an internal wall defining the cooling passage, to the zone, and wherein the cooling passage and the supplementary passage are defined by at least one core comprising a leachable material; and obturating the supplementary passage after removal of the core material by inserting a metallic plug into the supplementary passage to prevent leakage of cooling air through the supplemental passage, from the zone into the inlet, and leakage of cooling air through supplemental passage blade root portion from the inlet to an exterior.

* * * * *